US009620866B2

(12) United States Patent
Chang et al.

(10) Patent No.: US 9,620,866 B2
(45) Date of Patent: Apr. 11, 2017

(54) METHODS AND APPARATUS FOR FRAGMENTED PHASED ARRAY RADAR

(71) Applicant: Raytheon Company, Waltham, MA (US)

(72) Inventors: Yueh-Chi Chang, Northborough, MA (US); Peter R. Drake, Northborough, MA (US); Yuchoi F. Lok, Framingham, MA (US)

(73) Assignee: Raytheon Company, Waltham, MA (US)

( * ) Notice: Subject to any disclaimer, the term of this patent is extended or adjusted under 35 U.S.C. 154(b) by 780 days.

(21) Appl. No.: 14/037,564

(22) Filed: Sep. 26, 2013

(65) Prior Publication Data

US 2014/0085143 A1 Mar. 27, 2014

Related U.S. Application Data

(60) Provisional application No. 61/706,459, filed on Sep. 27, 2012.

(51) Int. Cl.

| | |
|---|---|
| ***H01Q 21/20*** | (2006.01) |
| ***H01Q 3/34*** | (2006.01) |
| ***H01Q 23/00*** | (2006.01) |
| ***H01Q 1/28*** | (2006.01) |
| ***H01Q 21/00*** | (2006.01) |
| *H01Q 3/24* | (2006.01) |

(52) U.S. Cl.

CPC ..... *H01Q 21/205* (2013.01); *H01Q 1/28* (2013.01); *H01Q 3/34* (2013.01); *H01Q 21/0025* (2013.01); *H01Q 23/00* (2013.01); *H01Q 3/242* (2013.01)

(58) Field of Classification Search

CPC ..... H01Q 1/281; H01Q 1/28; H01Q 21/0025; H01Q 21/0087; H01Q 21/20; H01Q 21/205; H01Q 23/00

See application file for complete search history.

(56) References Cited

U.S. PATENT DOCUMENTS 2,894,261 A * 7/1959 Yaru ..... H01Q 1/281 343/756
3,110,030 A * 11/1963 Cole, Jr. ..... H01Q 1/281 343/792.5

(Continued)

FOREIGN PATENT DOCUMENTS

| | | | |
|---|---|---|---|
| EP | 0 512 487 A1 | 11/1992 | |
| EP | 1 271 694 A2 | 1/2003 | |
| GB | EP 0250082 A2 * | 12/1987 | ..... H01Q 1/281 |

OTHER PUBLICATIONS

Douglas M. McKay and John E. Cortland; "Initial Analysis of Faceted Phased Arrays"; Raytheon Integrated Defense Systems, Sep. 21, 2011, 26 pages.

(Continued)

*Primary Examiner* — Gregory C Issing

(74) *Attorney, Agent, or Firm* — Daly, Crowley Mofford & Durkee, LLP

(57) ABSTRACT

Methods and apparatus for a phase array radar system having a fragmented array. In one embodiment, subarrays forming a generally rectangular shape are disposed on the surface of a truncated cone or a dome so that gaps are formed between adjacent segments of subarrays or between every adjacent subarrays.

13 Claims, 12 Drawing Sheets

(56) References Cited

U.S. PATENT DOCUMENTS 3,530,478 A * 9/1970 Mosko ..... H01Q 1/281 343/708
4,010,470 A * 3/1977 Jones, Jr. ..... H01Q 1/405 343/708
4,460,901 A * 7/1984 Tricoles ..... H01Q 1/405 343/785
4,980,692 A * 12/1990 Rudish ..... H01Q 21/205 343/700 MS
5,493,305 A * 2/1996 Wooldridge ..... H01Q 21/0087 342/368
5,648,786 A * 7/1997 Chung ..... H01Q 1/28 343/767
5,650,788 A * 7/1997 Jha ..... H01Q 1/242 343/700 MS
6,292,134 B1 * 9/2001 Bondyopadhyay .... H01Q 3/242 342/374
7,348,932 B1 * 3/2008 Puzella ..... H01Q 21/0025 342/373
8,279,131 B2 * 10/2012 Puzella ..... H01Q 1/02 343/700 MS
2003/0020666 A1 * 1/2003 Wright ..... H01Q 1/286 343/824
2003/0206132 A1 11/2003 Phelan et al.
2004/0070536 A1 * 4/2004 Stotler ..... H01Q 1/281 343/700 MS
2010/0073239 A1 * 3/2010 Tatarnikov ..... H01Q 1/241 343/700 MS

OTHER PUBLICATIONS

PCT Search Report of the ISA for PCT/US2013/061822 dated Jun. 6, 2014.
PCT Written Opinion of the ISA for PCT/US2013/061822 dated Jun. 6, 2014.
Notification Concerning Transmittal of International Preliminary Report on Patentability (Chapter 1 of the Patent Cooperation Treaty), PCT/US2013/061822, date of mailing Apr. 9, 2015, 9 pages.

* cited by examiner

METHODS AND APPARATUS FOR FRAGMENTED PHASED ARRAY RADAR

BACKGROUND

As is known in the art, the best performance of a phased array radar is achieved when the beam is pointing to the boresight, i.e., perpendicular to the aperture of the array. At the boresight location, the beam width is minimum and the antenna gain is the highest. One of the advantages of using a phased array radar is the ability to steer the beam without mechanical movement. However, when the beam is steered off the boresight, the beam shape is distorted with the beam width increased and antenna gain reduced. This reduction in antenna gain is referred to as scan loss, which can be estimated with Equation 1, which is set forth below:

$$L_{scan}=10\ \log(\cos(\theta)^{x}\cdot\cos(\phi)^{x}) \qquad \text{Eq.1,}$$

where θ is angle in the azimuth direction, ϕ is the angle in the elevation direction, and x is an empirical value, usually between 1.2 and 1.4.

To reduce the scan loss, one common practice is to have multiple faces of the phased array to cover the required scan angles. For example, for 360° coverage, a 4-faced radar has 1.8 to 2.1 dB less scan loss than a 3-face radar at widest scan angle. Some systems include a cylindrical phased array or phased array on the curved surface of the platform such as aircraft fuselage, which is called conformal array. For better elevation angle coverage, some phased arrays have a tilt angle, e.g., twenty degrees, to minimize the vertical scan angle for less scan loss.

SUMMARY

Exemplary embodiments of the invention provide methods and apparatus for a phased array radar having multiple flat subarray panels disposed on a curved surface, such as conical or dome-shaped, to form a fragmented array. The panel subarray provides the flexibility of building a larger array using a modular approach with lower cost. A fragmented array having a dome-shaped surface, for example, reduces scan loss in azimuth and elevation. The 360° coverage can be divided into many more smaller regions such that most of the panel subarrays do not have to scan wide angles. The fragmented array also provides a relatively lower grating lobe level due to the fact that panel subarrays are pointing to various directions. The gaps between the panels represent loss of the aperture area, which is not desirable. However, it minimizes the need of amplitude taper for the receive array to achieve low sidelobes.

In one aspect of the invention, a phased array radar system comprises: a first subarray disposed on a surface, wherein the surface is curved, and a second subarray disposed on the surface separately from the first subarray to form a fragmented array, wherein a gap between edges of the first and second subarrays increases as the curvature of the surface increases and/or the thickness of the panel subarray increases.

The system can further includes one or more of the following features: additional subarrays so that the first, second, and additional subarrays are substantially equally spaced about the curved surface, the surface is frusto-conical, the surface is dome-shaped, the first subarray comprises a integrated assembly including radiators, T/R modules, power manifolds and control circuitry, the first and second subarrays are substantially the same size, the first and second subarrays are substantially flat, and/or the first subarray has a rectangular lattice.

In another aspect of the invention for the frusto-conical surface, a phased array radar system comprises: a plurality of segments of subarrays disposed on a truncated conical surface to form a fragmented array; wherein several subarrays along the vertical direction form a segment with subarrays facing the same direction and having no gap between subarrays in each segment. With the frusto-conical surface, there are gaps between segments only, instead of gaps between all subarrays. Note that if the arrays are not tilted, such as when the surface is a cylinder, the array will look like a cylindrical array and the gaps will be caused only due to the thickness of the panel subarray.

The system can further include one or more of the following features: the surface is frusto-conical, the surface is dome-shaped, a third one of the plurality of segments of subarrays to form a beam opposite in direction to a beam formed by the first one of the plurality of segments of subarrays, further ones of the plurality of segments of subarrays to provide 360 degree beam coverage, the subarrays are substantially flat, and/or the subarrays are substantially similar in shape.

BRIEF DESCRIPTION OF THE DRAWINGS

The foregoing features of this invention, as well as the invention itself, may be more fully understood from the following description of the drawings in which.

DETAILED DESCRIPTION

Figure 1:
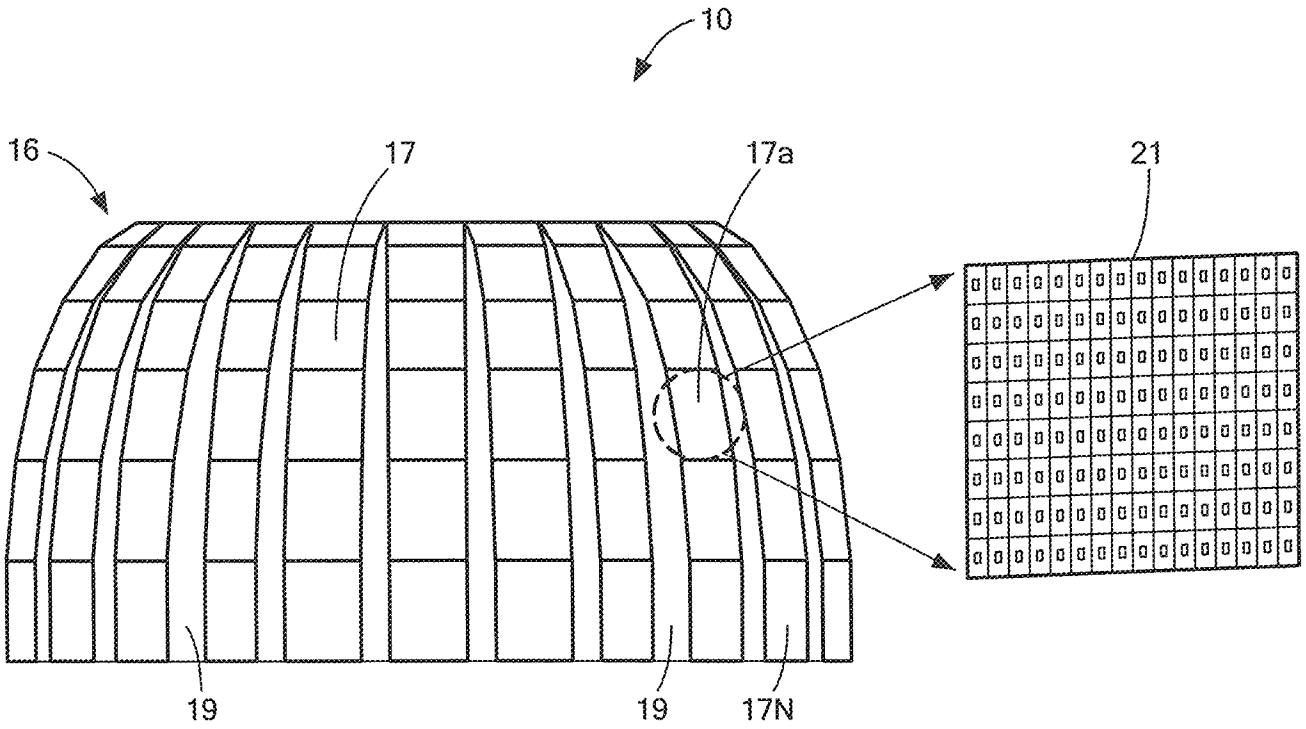
FIG. 1 is a representation of a fragmented array with a 128-element subarray in accordance with exemplary embodiments of the invention.

FIG. 1 shows an exemplary fragmented phased array radar system 10 including an antenna system 16 having a series of panel subarrays 17*a*-N disposed on an arcuate surface 19 in accordance with exemplary embodiments of the invention. In the illustrated embodiment, the surface 19 has a dome shape with an upper portion that is truncated. For the exemplary phased array having a panel subarray architecture, each subarray can be a highly integrated assembly 21 that incorporates 128 radiators, 128 transmit/receive (T/R) channels, for example, RF and power manifolds and control circuitry, all of which can be combined into a low cost light-weight assembly, an example of which is shown in U.S. Pat. No. 8,279,131, which is incorporated herein by reference.

Figure 1A:
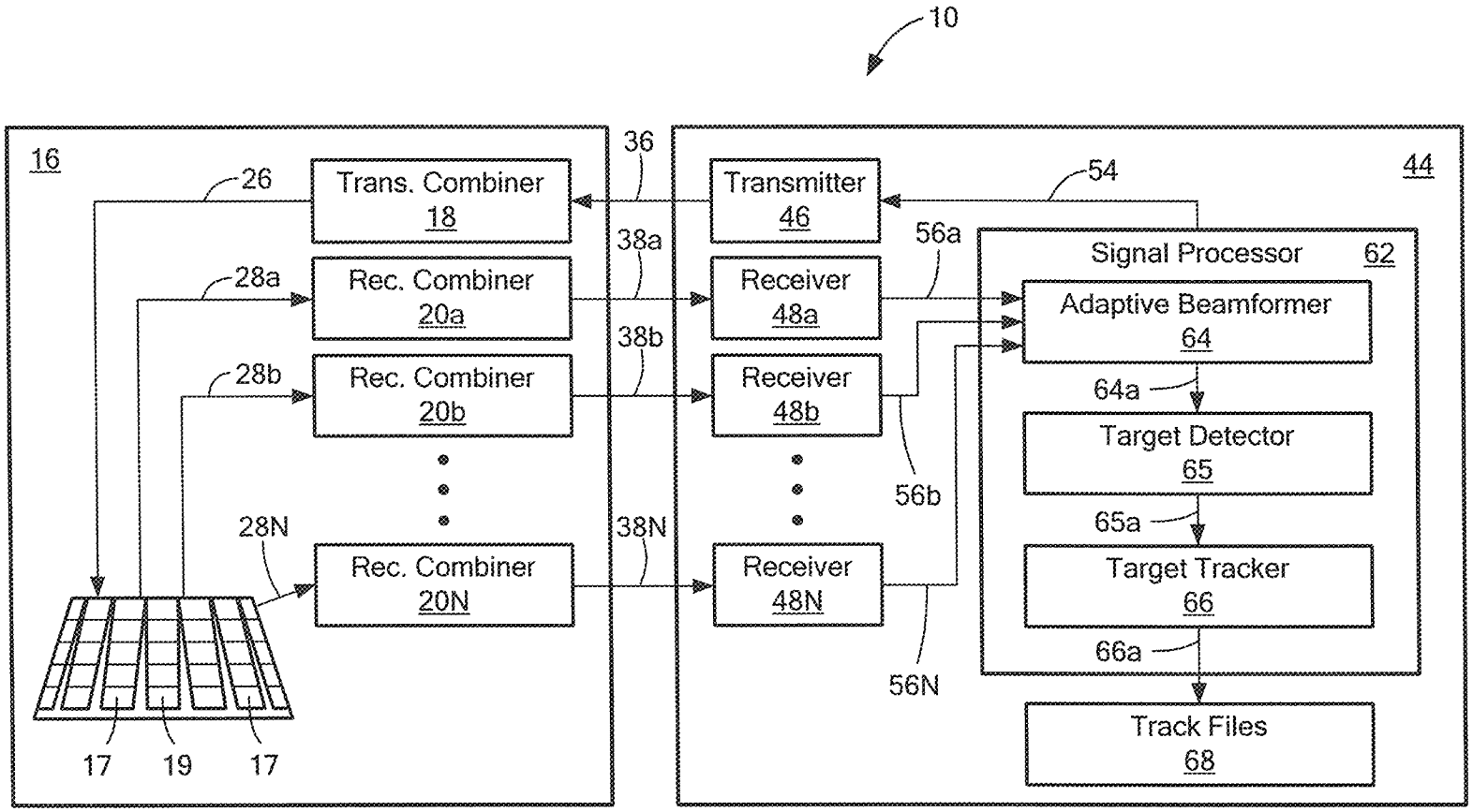
FIG. 1A is a schematic representation of a phased array radar system with a fragmented array in accordance with exemplary embodiments of the invention.

In one particular embodiment shown in FIG. 1A, each of receive combiner circuits 20 *a*-20N is a separate circuit board. Each of the receive combiner circuits 20 *a*-20N can be the same or they can be different, depending upon the form of the subarray to which they are coupled. The antenna array also transmits signals 26 provided to selected ones of the array elements via a transmit divider circuit 18. In general, the transmit combiner circuit 18 is different from the receive combiner circuits 20 *a*-20N in that the transmit combiner circuit 18 operates in conjunction with one selected set of array elements symmetrically disposed about the antenna array 16, for example, all of the array elements, while each of the receive combiner circuits 20 *a*-20N operates in conjunction with a different subarray having array elements.

The beamformed subarray output signals 38 *a*-38N are coupled to receivers to amplify and downconvert the beamformed subarray output signals 38 *a*-38N to lower frequency received signals 56 *a*-56N. A signal processor 62 includes a beamformer circuit 64 that digitizes the lower frequency received signals 56*a*-56N and performs beamforming. The beamforming applies complex adaptive weighting factors to the received signals 56*a*-56N and combines them to generate receive beam signals 64*a*. Exemplary implementations use low-cost analog (hard wired) beam former. In other embodiments, digital beam forming is contemplated.

The signal processor 62 also includes a target detector 65 to detect targets and to compute target locations using the adaptive receive beam signals 64 and provide target detection data 65*a* to a target tracker 66, which provides track update information 66*a* to track files 68. The track files 68 are provided to a radar system operator. The target tracker 65 can also provide a transmit signal direction 54 to a transmitter 46. An amplified signal 36 is provided to the transmit combiner circuit 18.

It is understood that a wide range of radar component and processing components, configurations and processing techniques known to one of ordinary skill in the art can be used in alternative embodiments.

Figure 2:
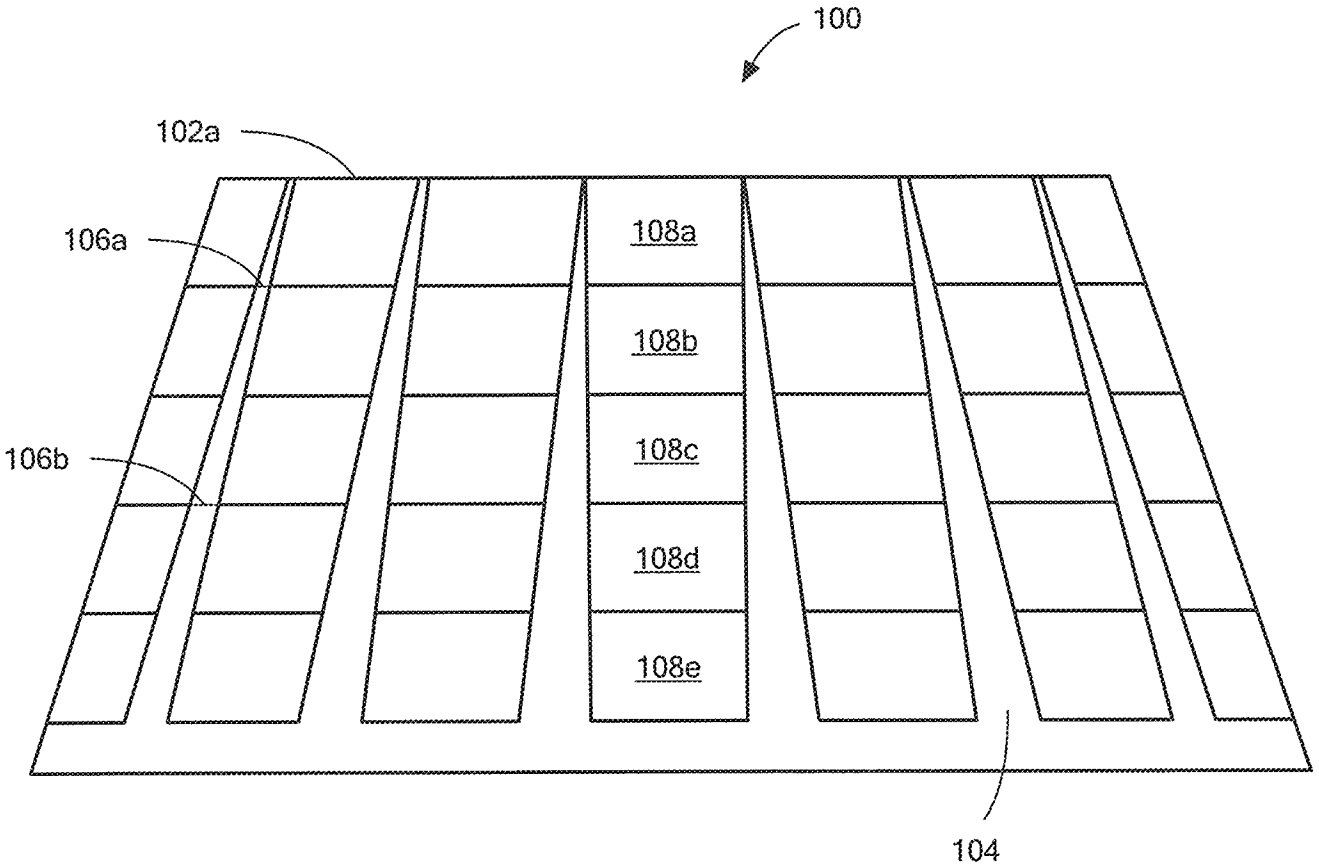
FIG. 2 is a schematic side view of a fragmented array with subarrays located on a frusto-conical surface.
Figure 3:
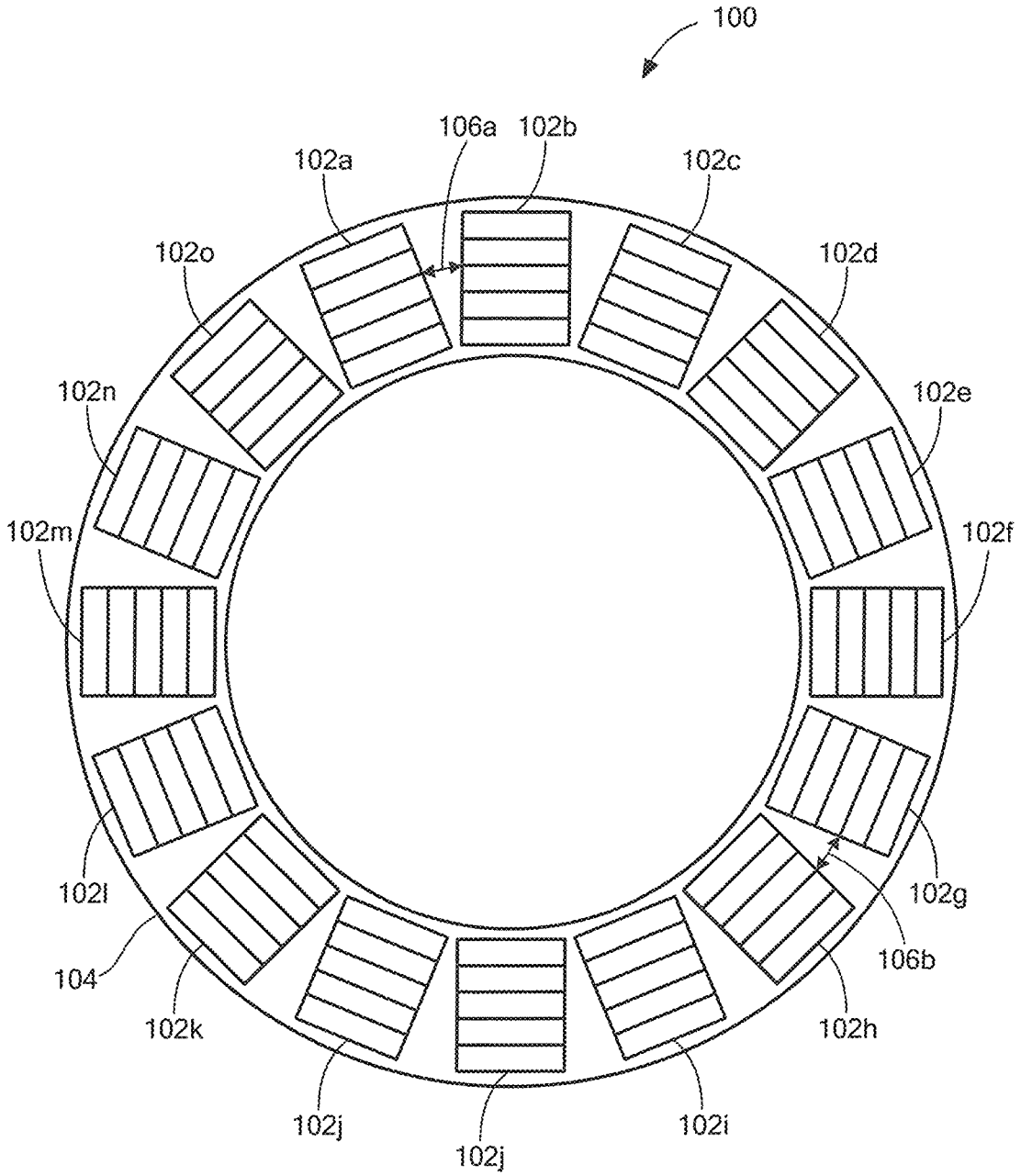
FIG. 3 is a schematic top view of the fragmented array of FIG. 2.

FIGS. 2 and 3 show an exemplary fragmented phase array radar system 100 having a series of subarray segments 102*a*-*o* formed of subarrays 108 disposed on frusto-conical surface 104 in accordance with exemplary embodiments of the invention. In the illustrative embodiment, the subarrays 108 are substantially similar in shape and located at a regular spacing that define consistent gaps 106 from between adjacent segments. In one embodiment, the subarrays 108 have a consistent width so that a gap 106*a* between adjacent subarrays 108 near the top of the subarray segments 102, has a smaller length than a length of a gap 106*b* near the bottom of the subarray segments.

As used herein, fragmented array refers an array in which the subarrays are substantially flat, and are applied to a curved surface, such as a frusto-conical or dome-shaped surface. As a result, there are gaps in various places instead of a continuous aperture as in conventional radars. For the frusto-conical case, there are segments of subarrays along the elevation direction facing the same direction. Gaps exist only between segments instead of between every pair of subarrays as in the dome case.

Referring again to FIG. 1, an exemplary fragmented phased array includes a 128-element subarray having a rectangular lattice. Other subarray shapes, such as triangular and/or hexagonal, can be used. The element lattice can be triangular instead of rectangular to minimize the grating lobe. In general, the number of elements in each subarray can range from about 16 to about 256, while about 64 or 128 is typical. In one embodiment, each subarray has substantially the same shape. It is understood that any practical shape that minimizes gaps when applied to a curved surface can be used. In exemplary embodiments, the subarrays are substantially flat. In general, any practical curved surface can be used to support the substantially flat subarrays. Exemplary curved surfaces can conform to surfaces on a ship, aircraft or other vehicle or structure. While the subarrays can be provided in any practical size, exemplary subarrays have a size of about 10.1"×7.4". For typical applications, a desirable subarray size is from about 64 to about 128 elements.

In operation, selected ones of the subarray segments 102 are activated to form one radar beam as long as the surface normal of the subarray is within ±67 degrees, for example, from the beam direction. In one example, six of the sixteen segments are active at one time to form a beam. A different set of six segments can be activated to form another beam at a different frequency.

While the illustrative embodiment shows sixteen subarray segments, it is understood that any practical number of subarrays and segments can be used to meet the needs of a particular application. Accordingly, different number of segments can be activated at one time to form a beam. In exemplary embodiments, the subarrays 102 comprise circuit boards 108*a*-*e* mounted with at least one patch antenna. It is further understood that any practical number of circuit boards can be used.

The subarrays can be provided as any suitable configuration that can provide a fragmented array. Exemplary subarrays are shown and described in U.S. Pat. Nos. 7,348,932 and 8,279,131, which are incorporated herein by reference. As described in U.S. Pat. No. 7,348,932, "In one so-called 'packageless T/R channel' embodiment, a tile sub-array simultaneously addresses cost and performance for next generation radar and communication systems. Many phased array designs are optimized for a single mission or platform. In contrast, the flexibility of the tile sub-array architecture described herein enables a solution for a larger set of missions. For example, in one embodiment, a so-called upper multi-layer assembly (UMLA) and a lower multi-layer assembly (LMLA), each described further herein, serve as common building blocks. The UMLA is a layered RF transmission line assembly which performs RF signal distribution, impedance matching and generation of polarization diverse signals. Fabrication is based on multi-layer printed wiring board (PWB) materials and processes. The LMLA integrates a package-less Transmit/Receive (T/R) channel and an embedded circulator layer sub-assembly. In a preferred embodiment, the LMLA is bonded to the UMLA using a ball grid array (BGA) interconnect approach. The package-less T/R channel eliminates expensive T/R module package components and associated assembly costs. The key building block of the package-less LMLA is a lower multi-layer board (LMLB). The LMLB integrates RF, DC and Logic signal distribution and an embedded circulator layer. All T/R channel monolithic microwave integrated circuits (MMIC's) and components, RF, DC/Logic connectors and thermal spreader interface plate can be assembled onto the LMLA using pick and place equipment."

Figure 4:
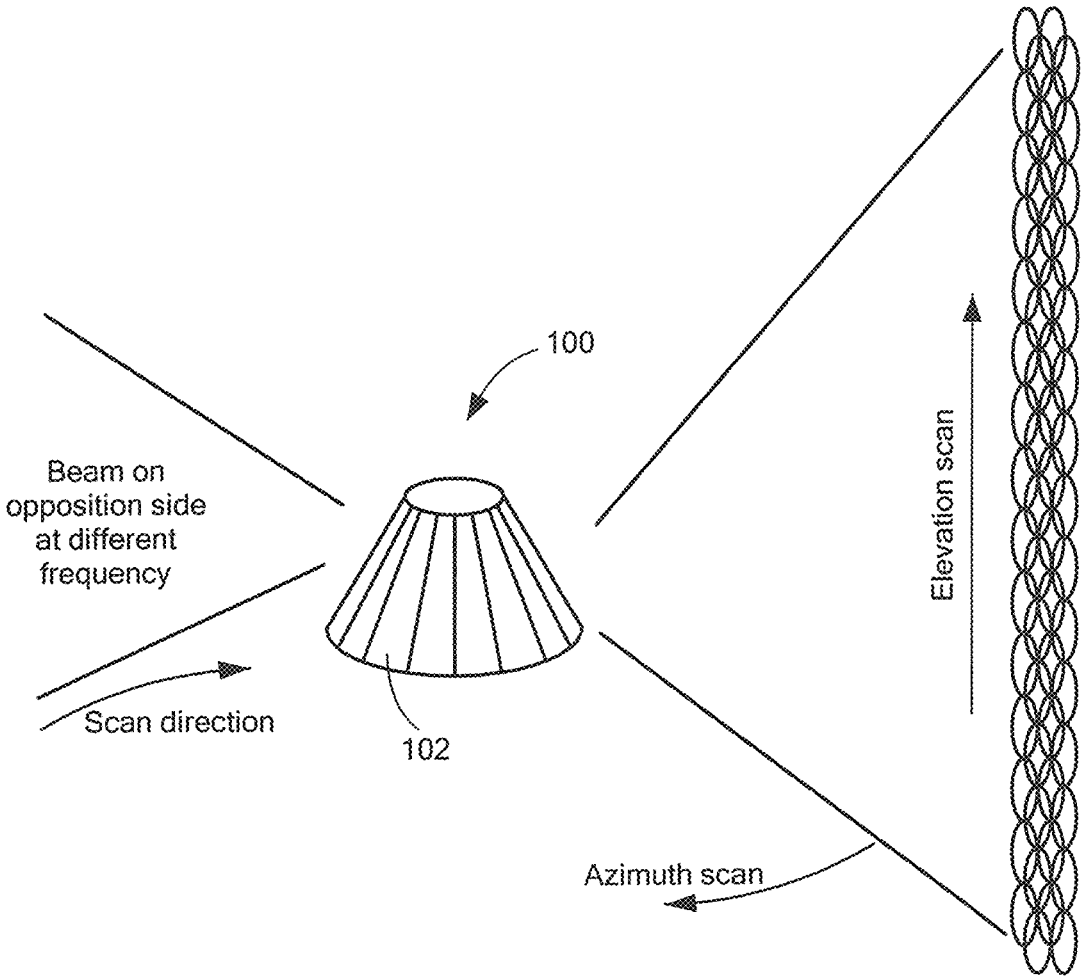
FIG. 4 is a schematic representation of a fragmented array performing elevation and azimuth scans with beams at opposing locations on the array.

As shown in FIG. 4, when the radar is operating in search mode, the radar beams rotate in a manner similar to a light house, for example, as the subarrays 102 are activated in sequence. As can be seen, a scan in elevation and azimuth can be performed by forming beams in a desired way. In an exemplary embodiment, a first beam can be formed on one side of the array by activating a first set of subarrays and a second beam can be formed at the opposite side, e.g., 180 degrees in relation to the first beam, of the array by activating a second set of subarrays. In other embodiments, more than two beams can be formed at a given time.

Figure 5:
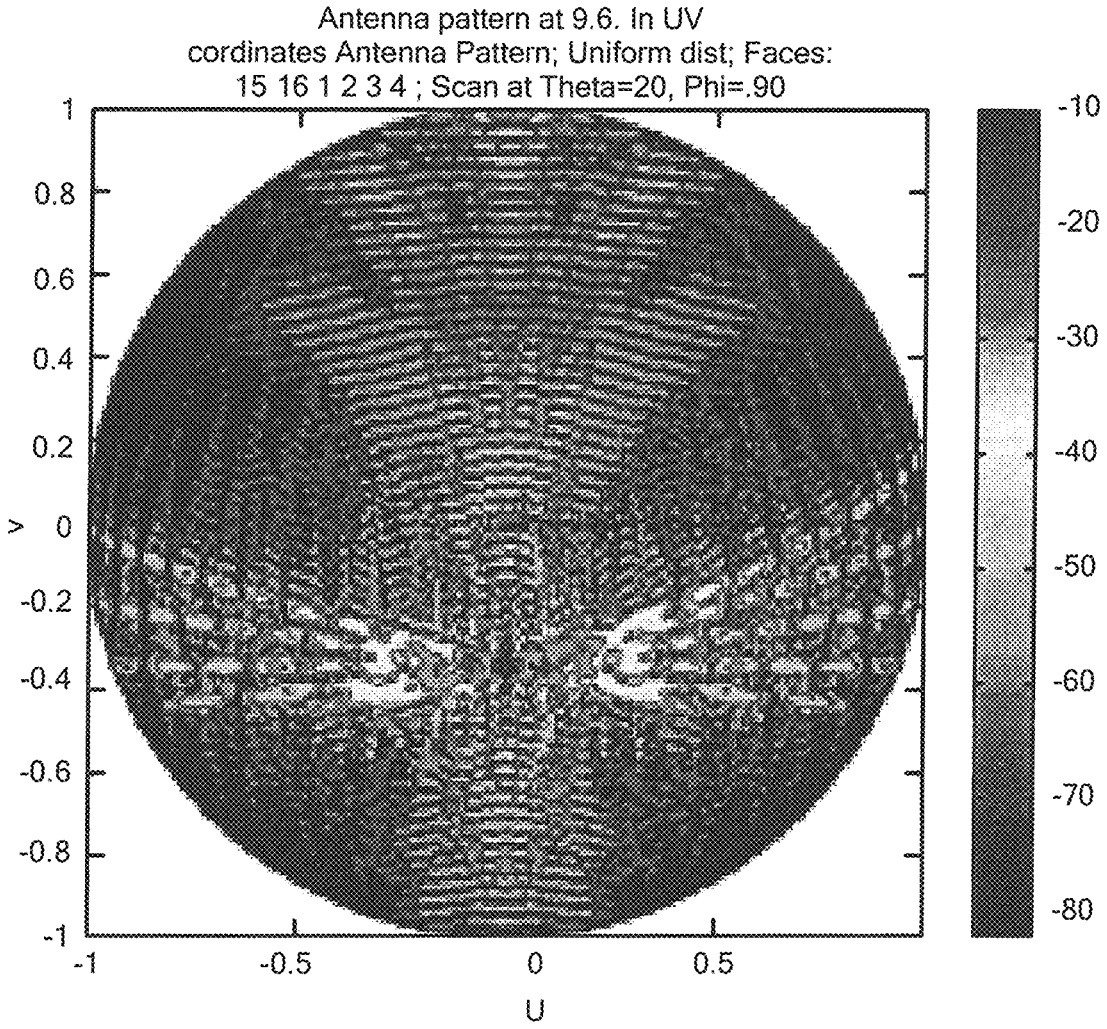
FIG. 5 shows an exemplary antenna pattern in UV coordinates for a fragmented array on a frustro-conical surface.

FIG. 5 shows an exemplary simulated antenna pattern for a fragmented array, as described above. It can be seen that the antenna sidelobe peaks, which are usually on the principle planes, are distributed in multiple directions. This clearly indicates one of the major benefits of the fragmented array, namely to have the diffusion of the grating lobes as shown.

Figure 6:
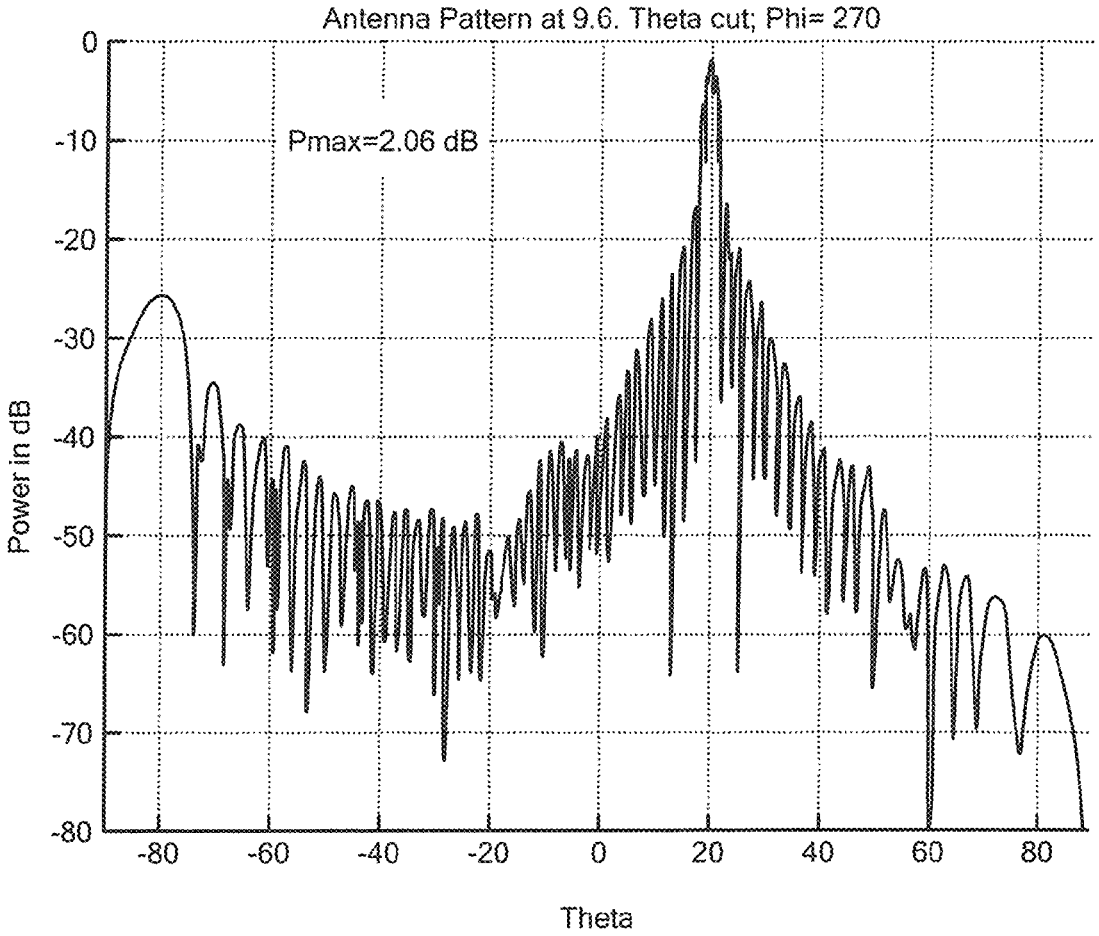
FIG. 6 shows an exemplary antenna pattern in the elevation plane for a fragmented array on a frustro-conical surface.
Figure 7:
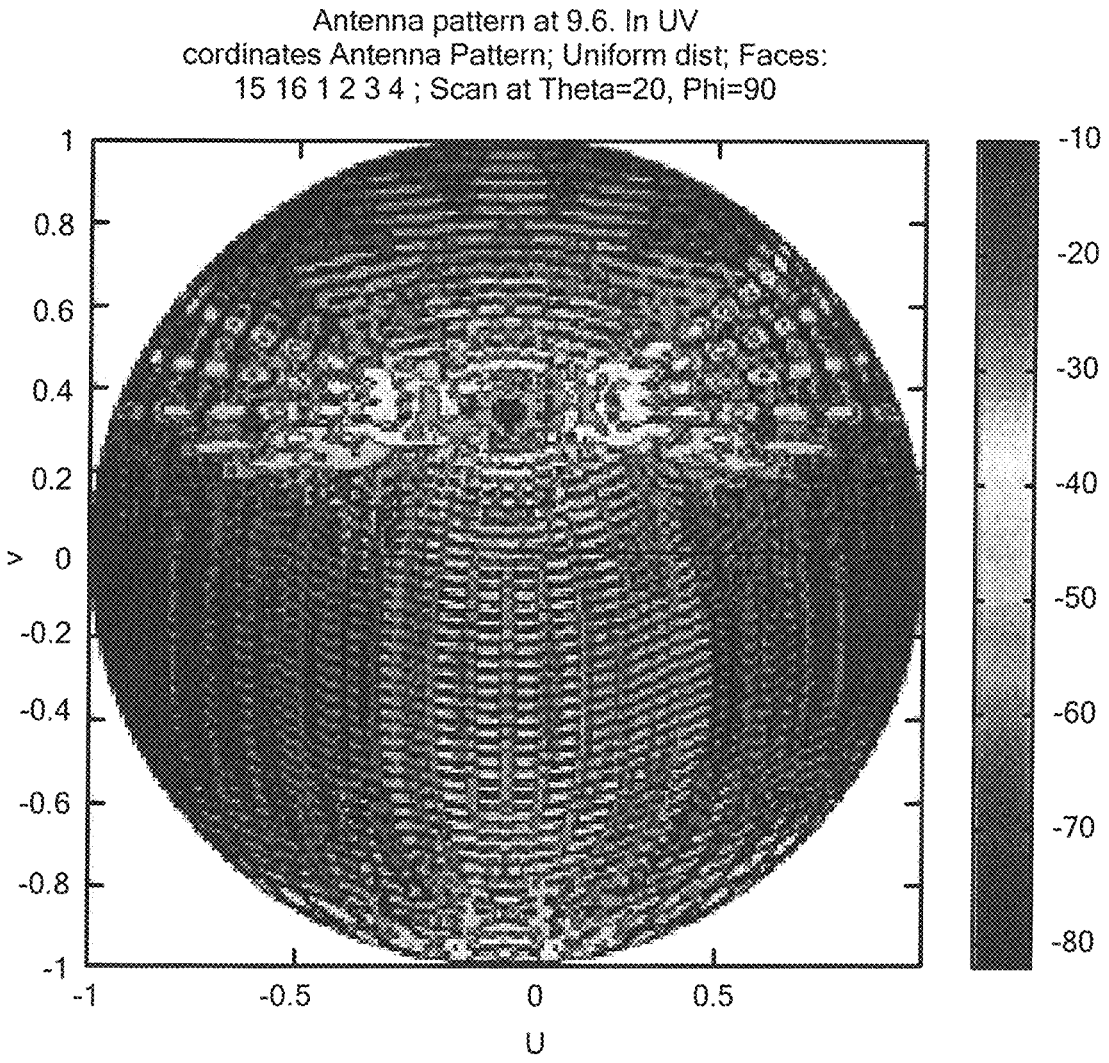
FIG. 7 shows another exemplary antenna pattern in UV coordinates for a fragmented array on a frustro-conical surface.

FIG. 6 shows a grating lobe in the vertical plan of the antenna pattern of around −24 dB below the main beam. Although the gaps between the subarrays at the top are smaller than the bottom, as shown and described above, the grating lobe level at the top is the same as at the bottom, as shown in FIG. 7.

It is understood that the inventive fragmented array has diffused grating lobes in the horizontal scan because of the changeover of the subarrays as the scan angle exceeds ±67 degrees. The level of the diffused grating lobes are typical significantly lower than the regular grating lobes.

Figure 8:
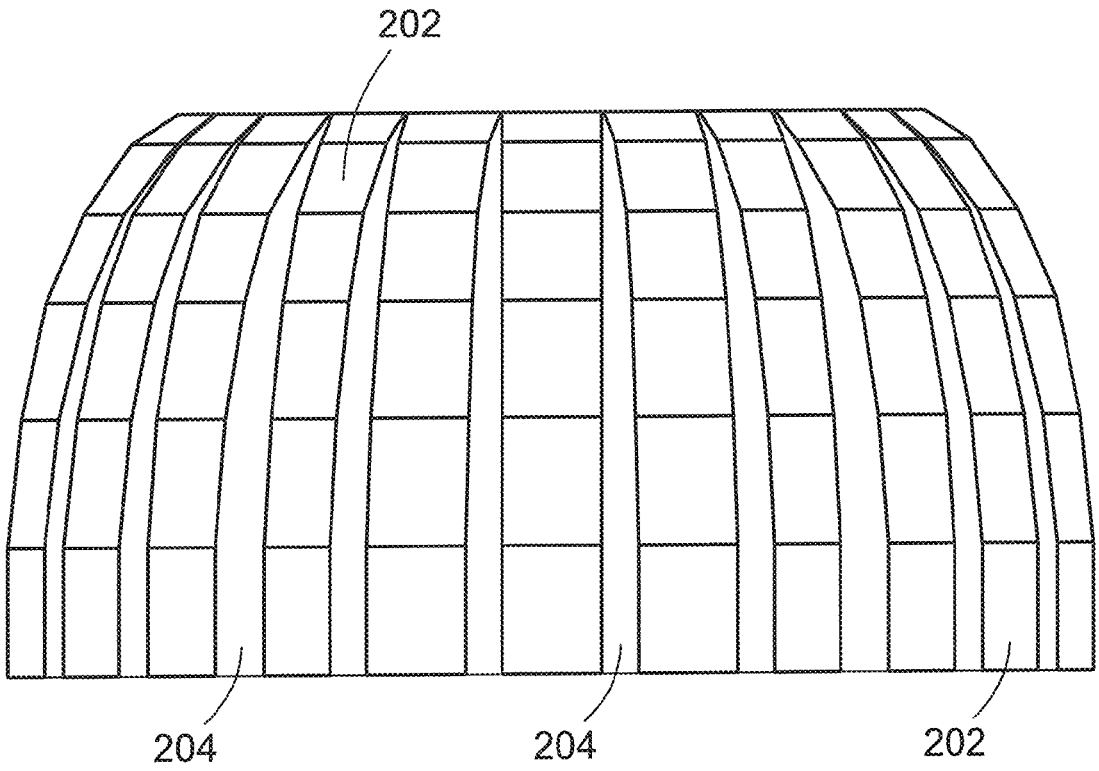
FIG. 8 is a schematic side view of a fragmented array with subarrays located on a dome surface.
Figure 9:
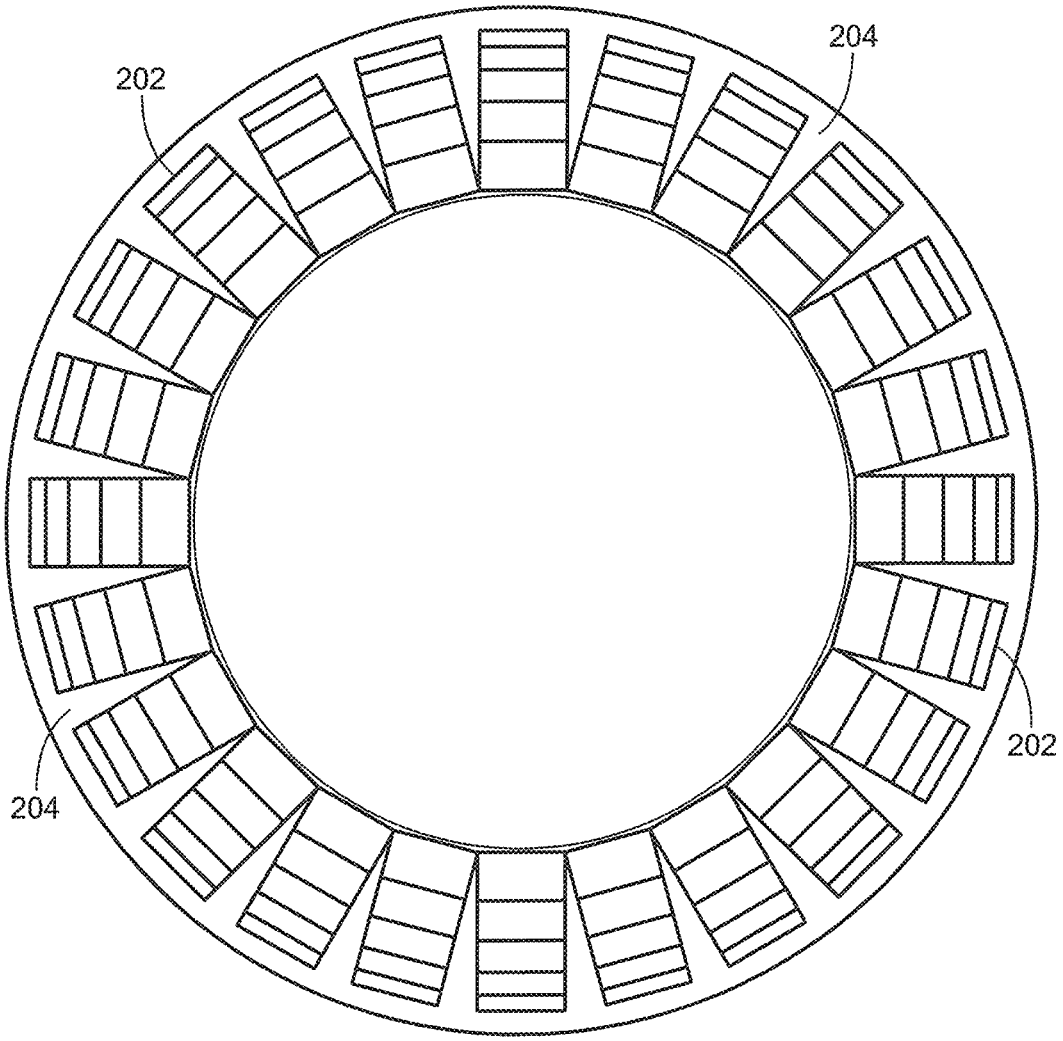
FIG. 9 is a schematic top view of a fragmented array with subarrays located on a dome surface.

FIG. 8 shows an exemplary fragmented array having subarrays 202 disposed on a dome-shaped surface 204. FIG. 9 shows a top view of the fragmented array of FIG. 8.

Figure 10:
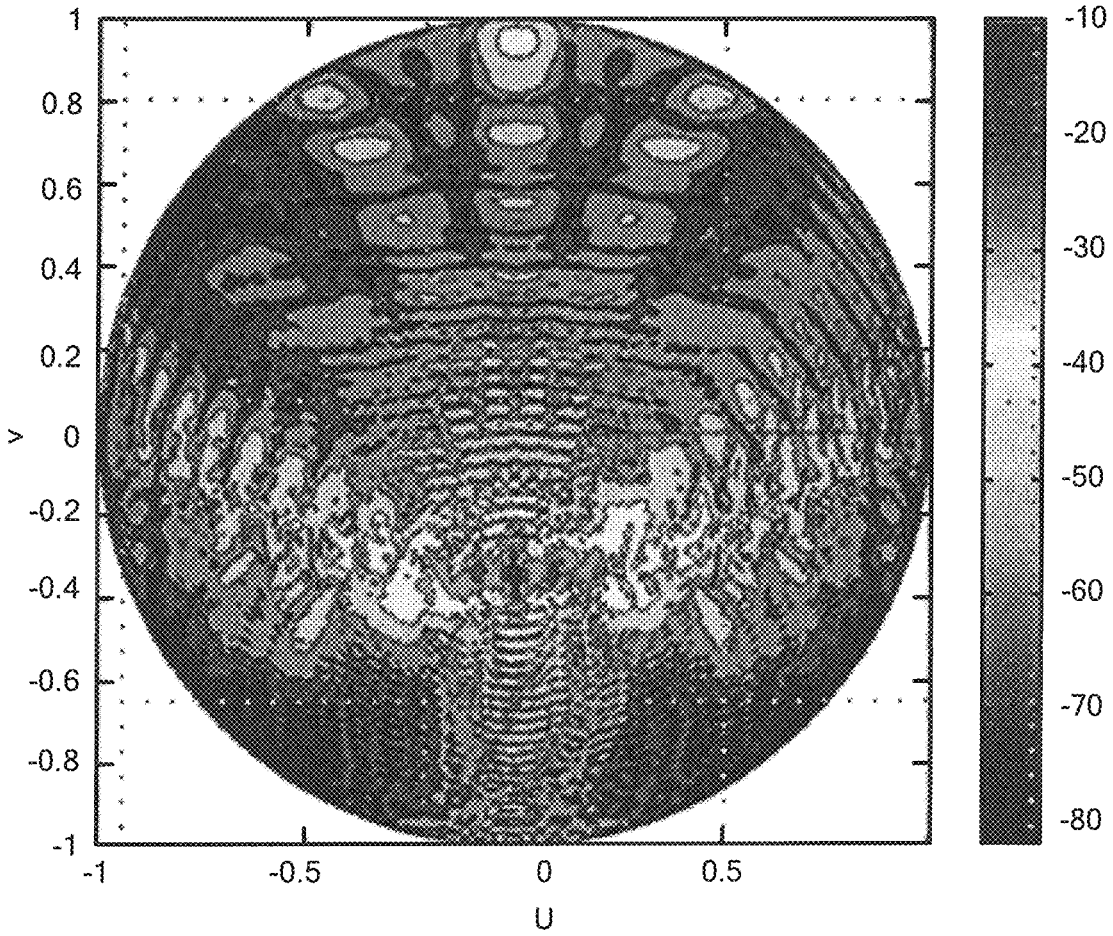
FIG. 10 shows an exemplary antenna pattern in UV coordinates for a fragmented array on a dome surface.

FIG. 10 shows an exemplary antenna pattern in UV coordinates for a fragmented array on a dome surface.

It is understood that signal processing for the inventive fragmented arrays is within the ordinary skill in the art. With the advance of technologies in Analog to Digital Converter (ADC) and Digital to Analog Converter (DAC), sampling rates have been increased and cost has been reduced significantly. This makes it feasible to convert received the RF signal at each subarray output and digitally process the signals for beamforming easily and efficiently.

While exemplary surfaces are shown and described on which subarrays can be disposed, it is understood that other arcuate surfaces can be used to meet the needs of a particular application. For example, it could be part of the aircraft fuselage or ship structure that represents a complex shape rather than conical or spherical.

Figure 11:
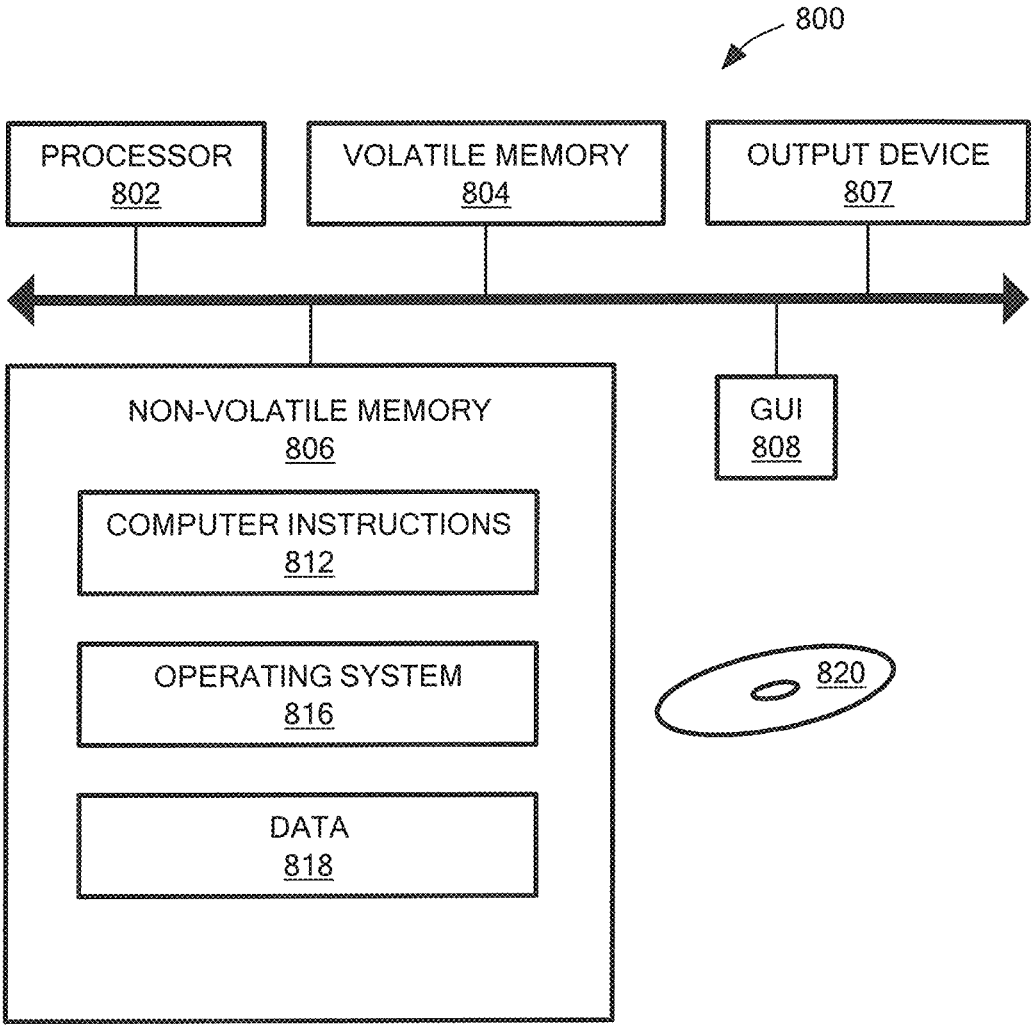
FIG. 11 shows an exemplary computer than can perform at least a portion of the processing described herein.

FIG. 11 shows an exemplary computer 800 that can perform at least part of the processing described herein. The computer 800 includes a processor 802, a volatile memory 804, a non-volatile memory 806 (e.g., hard disk), an output device 807 and a graphical user interface (GUI) 808 (e.g., a mouse, a keyboard, a display, for example). The non-volatile memory 806 stores computer instructions 812, an operating system 816 and data 818. In one example, the computer instructions 812 are executed by the processor 802 out of volatile memory 804. In one embodiment, an article 820 comprises non-transitory computer-readable instructions.

Processing may be implemented in hardware, software, or a combination of the two. Processing may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform processing and to generate output information.

The system can perform processing, at least in part, via a computer program product, (e.g., in a machine-readable storage device), for execution by, or to control the operation of, data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer. Processing may also be implemented as a machine-readable storage medium, configured with a computer program, where upon execution, instructions in the computer program cause the computer to operate.

Processing may be performed by one or more programmable processors executing one or more computer programs to perform the functions of the system. All or part of the system may be implemented as, special purpose logic circuitry (e.g., an FPGA (field programmable gate array) and/or an ASIC (application-specific integrated circuit)).

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A phased array radar system, comprising:

a plurality of subarrays disposed on a support surface, wherein the support surface is curved, and wherein each of the plurality of subarrays are disposed separately and substantially equally spaced about the support surface to form a fragmented array, and wherein each of the plurality of subarrays are substantially the same size;

wherein the fragmented array comprises a plurality of segments, each segment comprising one or more associated ones of the plurality of subarrays;

wherein a size of gap between edges of adjacent segments varies based on a shape and width of each of the plurality of subarrays and a shape of the curved support surface, wherein the size of gap increases from a first size proximate to a top end of the adjacent segments to a second size proximate to a bottom end of the adjacent segments; and wherein each of the plurality of subarrays comprise an integrated assembly including radiators, transmit/receive (T/R) modules, power manifolds and control circuitry disposed on a printed circuit board bonded to each of the plurality of subarrays by an interconnect selected from a group consisting of a ball grid array (BGA) and vias.

2. The system according to claim 1, wherein the curved support surface is frusto-conical.

3. The system according to claim 1, wherein the curved support surface is dome-shaped.

4. The system according to claim 1, wherein each of the plurality of subarrays are substantially flat.

5. The system according to claim 1, wherein at least one subarray has a rectangular lattice.

6. A phased array radar system, comprising:

a plurality of segments of subarrays disposed on a curved support surface to form a fragmented array, wherein each of the subarrays are substantially the same size and shape;

wherein a size of a gap between edges of subarrays in a first one of the plurality of segments of subarrays and edges of subarrays in a second one of the plurality of segments of subarrays depends on a shape and width of the subarrays and a shape of the curved support surface, wherein the first and second ones of the plurality of segments of subarrays are adjacent, wherein the size of the gap increases from a first size proximate to a top end of the first one of the plurality of segments of subarrays to a second size proximate to a bottom end of the second one of the plurality of segments, and wherein each of the subarrays comprise an integrated assembly including radiators, transmit/receive (T/R) modules, power manifolds and control circuitry disposed on a printed circuit board bonded to each of the subarrays by an interconnect selected from a group consisting of a ball grid array (BGA) and vias.

7. The system according to claim 6, wherein the curved support surface is frusto-conical.

8. The system according to claim 6, wherein the curved support surface is dome-shaped.

9. The system according to claim 6, further comprising additional segments of subarrays to form a beam opposite in direction to a beam formed by the first one of the plurality of segments of subarrays.

10. The system according to claim 6, further comprising additional segments of subarrays to provide 360 degree beam coverage.

11. The system according to claim 6, wherein the subarrays are substantially flat.

12. The system according to claim 6, wherein the subarrays have a shape selected from the group consisting of rectangular, triangular, and hexagonal.

13. A method, comprising:

employing a plurality of segments of subarrays disposed on a curved support surface to form a fragmented array, wherein each of the subarrays are substantially the same size and shape, wherein a size of a gap between edges of subarrays in a first one of the plurality of segments of subarrays and edges of subarrays in a second one of the plurality of segments of subarrays depends on a shape and width of the subarrays and a shape of the curved support surface, wherein the first and second ones of the plurality of segments of subarrays are adjacent, wherein the size of the gap increases from a first size proximate to a top end of the first one of the plurality of segments of subarrays to a second size proximate to a bottom end of the second one of the plurality of segments, and wherein each of the subarrays comprise an integrated assembly including radiators, transmit/receive (T/R) modules, power manifolds and control circuitry disposed on a printed circuit board bonded to each of the subarrays by an interconnect selected from a group consisting of a ball grid array (BGA) and vias; and selectively activating ones of the plurality of segments of subarrays to form beams for beam coverage of 360 degrees.

* * * * *